US006371220B1

(12) United States Patent
Hesse et al.

(10) Patent No.: US 6,371,220 B1
(45) Date of Patent: Apr. 16, 2002

(54) PNEUMATICALLY REVERSIBLE RAM DRILLING TOOL

(75) Inventors: Alfons Hesse; Franz-Josef Püttmann, both of Lennestadt (DE)

(73) Assignee: Tracto-Technik - Paul Schmidt - Spezialmaschinen, Lennestadt (DE)

( * ) Notice: Subject to any disclaimer, the term of this patent is extended or adjusted under 35 U.S.C. 154(b) by 0 days.

(21) Appl. No.: 09/464,501

(22) Filed: Dec. 15, 1999

(30) Foreign Application Priority Data

Dec. 18, 1998 (DE) ..... 198 58 519

(51) Int. Cl.[7] ..... E21B 4/14
(52) U.S. Cl. ..... 175/19; 173/91; 175/296
(58) Field of Search ..... 175/19, 296; 173/91

(56) References Cited

U.S. PATENT DOCUMENTS 3,727,701 A * 4/1973 Sudnishnikov et al. ..... 173/91
4,683,960 A * 8/1987 Kostylev et al. ..... 173/91
5,148,878 A * 9/1992 Schmidt et al. ..... 175/296
5,172,771 A * 12/1992 Wilson ..... 173/1
5,603,383 A * 2/1997 Wentworth et al. ..... 173/91
5,960,892 A * 10/1999 Balve et al. ..... 175/91

FOREIGN PATENT DOCUMENTS

DE 34 37 226 4/1986
EP 0 484 839 5/1992

* cited by examiner

*Primary Examiner*—Hoang Dang

(57) ABSTRACT

In a ram drilling tool for producing bores in the ground and having a percussion piston which is moved to and fro in a casing, a control sleeve is guided such that it can be displaced on a control pipe projecting into a percussion-piston chamber and whose axial position determines the direction of movement of the tool. In order to permit the movement to be reversed, a control chamber connected to a control-air line is arranged between the control pipe and the control sleeve, and its front end terminates flush with a collar at the front end of the control pipe.

7 Claims, 2 Drawing Sheets

PNEUMATICALLY REVERSIBLE RAM DRILLING TOOL

Figure 1:
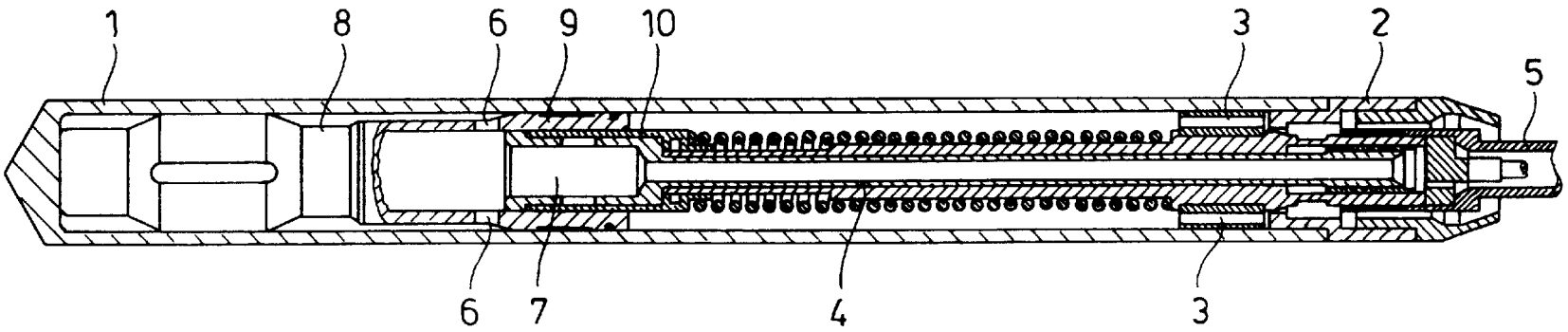

The invention relates to a pneumatically reversible ram drilling tool (mole), in particular for the production of underground bores without trenching and for laying lines in the ground.

Ram drilling tools of this type are also used for widening pilot bores and for the destructive replacement of pipes laid in the ground; they have a self-controlling percussion piston which can be moved to and fro in a casing by means of compressed air and which transfers its kinetic energy to the casing in a front dead-point position or at a rear dead-point position. In this way, the tool can be operated in forward travel or in reverse travel and, for example when it encounters an obstacle in the ground, or when a blind bore is being produced, can be moved out of the bore in the ground in a reversing operation.

In order to reverse the tool, for example from forward travel to reverse travel, a reversing system is required, which has the effect of braking the percussion piston in its front dead-point position, essentially without transferring its kinetic energy to the casing, with the aid of the operational air, and also has the effect of displacing the rear dead-point position reverses, which ensures that the percussion piston gives up its kinetic energy, for example, to a rear inner collar of the casing.

Reversing systems of this type are known in various versions. For example, there are reversing systems actuated mechanically with the aid of the compressed-air hose and those actuated pneumatically or spring-pneumatically with the aid of the operational air. They can be provided with a mechanical, pneumatic or spring-pneumatic interlock, in order to prevent inadvertent reversing from forward travel to reverse travel and vice versa.

European laid-open specification 0 484 839 has already disclosed a ram drilling tool whose spring-pneumatic reversing system operates not only with the operational air fed to the percussion-piston chamber but also with control air fed separately. In order to make this possible, the tool has a stationary control pipe mounted at the tail end, which is surrounded by a similarly stationary concentric shorter control-air pipe in such a way that an annular duct results, which is connected to a control-air line. The annular duct between the two pipes is connected via a control-air opening to a reversing chamber between the front part of the control pipe and a control sleeve. The control sleeve is mounted on the control pipe at its front end and such that it can be displaced on the control-air pipe at its rear end, and is moved into the forward travel position with the aid of the control air and—after the reversing chamber has been vented—is moved into its reverse travel position with the aid of the operational air present in the working chamber of the percussion piston. This takes place counter to the force of a prestressed spring arranged in the reversing chamber.

The disadvantage with this tool is that the control sleeve is reversed from forward travel to reverse travel with the aid of the working air acting on its front end face arranged in the percussion-piston chamber, counter to the action of the prestressed spring arranged in the reversing chamber. The front end face of the control sleeve is relatively large, since the compression spring is arranged in the reversing chamber located between the control pipe and the control sleeve, and the chamber therefore has to be dimensioned accordingly. Since the spring force and the force exerted by the operational compressed air on the control sleeve have to have a balanced relationship with each other, the known reversing system requires a correspondingly or voluminously large spring with regard to the size of that end face of the control sleeve to which the operational compressed air is applied.

On the basis of this prior art, the invention is based on the problem of keeping that area of the control sleeve to which operational compressed air is applied as small as possible, in order in this way to be able to use a correspondingly weakly dimensioned return spring for the control sleeve.

This object is achieved in that, in a ram drilling tool having a control pipe fixed to the casing and entering the working chamber of the percussion piston and having at least one control opening, a control sleeve which can be displaced on the control pipe and a control chamber, connected to a control-air line, between the control pipe and the control sleeve, the front end of this control sleeve essentially terminates flush with a collar at the front end of the control pipe.

The collar serves as a stationary control end for the front travel of the tool, whereas conventional tools often have a front control edge which can be displaced with the control sleeve. This offers the advantage that the collar can perform the sealing with respect to the percussion-piston surface which otherwise would be performed by the control sleeve. In addition, arranging the control edge on the control pipe fixed to the casing offers the advantage that it does not change its position in the event of any stressing or bending of the tool casing, whereas in the case of a front control edge arranged on the control sleeve, displacement can occur as a result of increased friction on the basis of bending or stressing of the casing. Bending occurs in particular when the ram drilling tool is passing through ground formations of different strengths and/or on a curved path. In addition, the collar protects the control sleeve located axially behind it against being displaced by the percussion piston moving towards the rear, and serves as a stop for the control sleeve in its forward-travel position.

Accordingly, the front end face of the control sleeve is shielded by the control-pipe collar against the operational air pressure in the percussion-piston chamber, that is to say, in the front end position of the control sleeve, the operational compressed air acts in the axial direction only on the end of the stationary control pipe, but not on the control sleeve.

The control sleeve is preferably supported axially in the tool casing by means of a prestressed return spring; it is then moved from its forward-travel position into its reverse-travel position with the aid of the control air entering the control chamber, counter to the force of the prestressed return spring, without the operational compressed air being involved in this to any noticeable extent.

The control chamber is preferably located between a rear shoulder of the control pipe and an inner collar of the control sleeve, whose axial movement can be limited by a rear stop shoulder.

In order to supply the control chamber with controlled air, the wall of the control pipe can be provided on the outside with a longitudinal groove which, together with a guide pipe surrounding the control pipe concentrically, forms a control-air duct opening into the control chamber. The control-air duct is connected to a control-air line, which preferably runs through the compressed-air hose via which the tool is supplied with operational air.

Figure 2:
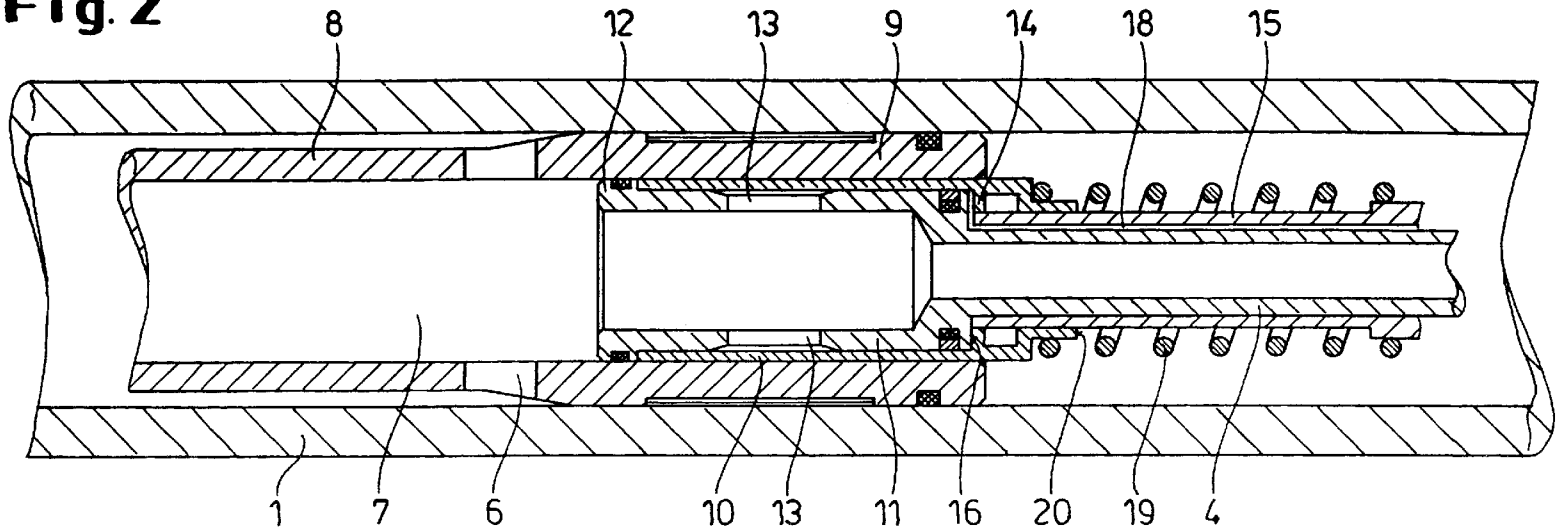
Figure 3:
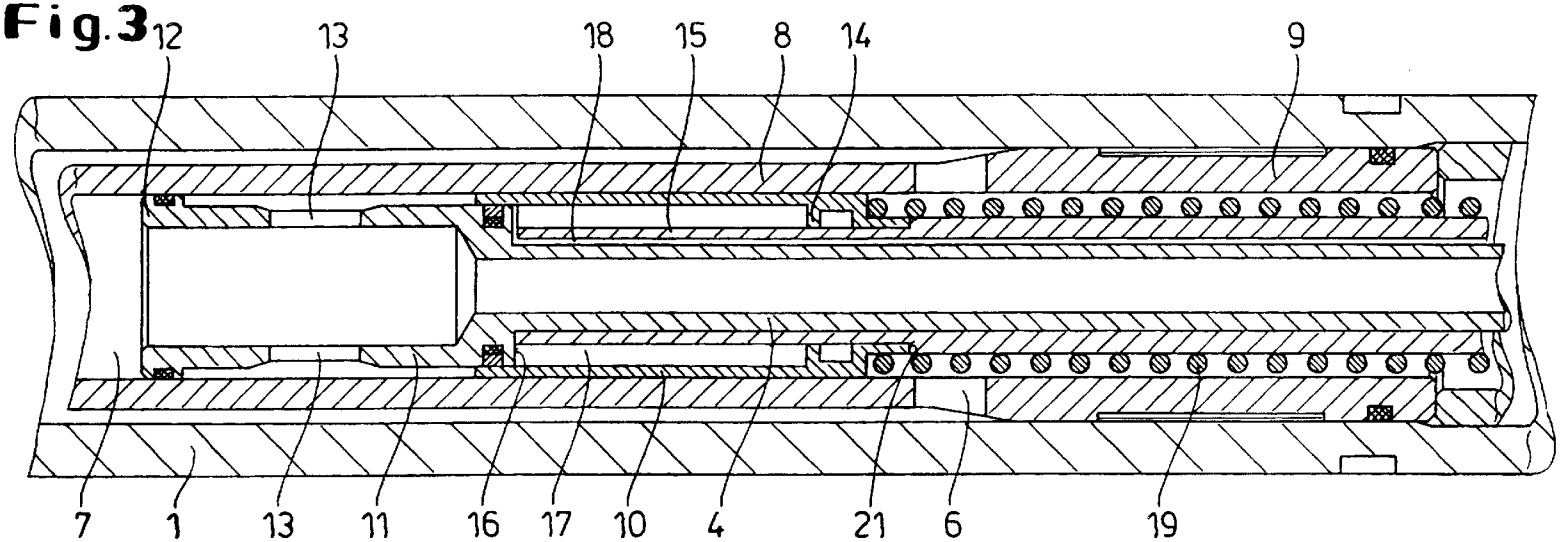

The invention will be explained in more detail below using an exemplary embodiment illustrated in the drawing, in which:

FIG. 1 shows the overall view of a ram drilling tool having a reversing system according to the invention, in a simplified illustration, FIG. 2 shows an enlarged illustration of the reversing system with the control sleeve in the forward-travel position and FIG. 3 shows an illustration corresponding to FIG. 2, but with the control sleeve in its reverse-travel position.

The ram drilling tool, from the point of view of its design and working principle, is constructed like the ram drilling tool described in German patent 21 57 259, but its reversing system is composed differently; it comprises a casing 1, whose tip can be designed to be central, as illustrated, or off-centre and in whose rear part there is arranged a stop ring 2 with exhaust-air ducts 3 parallel to the axis. Mounted in the stop ring 2 such that it can be neither rotated nor displaced is a control pipe 4, whose rear end is connected to an operational-air hose 5. If this connection is fixed against rotation, there is then the possibility of rotating the ram drilling tool with the aid of the hose from outside the ground. The front end of the control pipe 4 projects into a chamber 7, provided with control openings 6, in a percussion piston 8.

Located between the control pipe 4 and the jacket 9 of the percussion piston 8, bounding the percussion-piston chamber 7, is an axially displaceable control sleeve 10, whose front part is mounted such that it can be displaced on the front, larger-diameter part 11 of the control pipe 4. At the front end of the control pipe 4 or of the larger-diameter part 11 of the control pipe, there is an outer collar 12, which covers the front annular end face of the control sleeve 10 and terminates flush with the control sleeve 10. Furthermore, control openings 13 are arranged in the larger-diameter front part 11 of the control pipe 4 and, during the forward-travel operation of the ram drilling tool, as illustrated in FIG. 2, are closed by the control sleeve 10. Located in the rear part of the control sleeve 10 is an inner collar 14, with which the control sleeve is guided on a pipe 15 surrounding the control pipe 4. Furthermore, between the inner collar 14 and a rear shoulder 16 of the larger-diameter part 11 of the control pipe there is a control chamber 17, into which a control-air duct 18 opens. The control-air duct 18 consists of a longitudinal groove in the wall of the control pipe 4, this groove being closed on the outside by the guide pipe 15.

The control sleeve 10 is supported on the stop ring 2 by a prestressed return spring 19 and, in its forward-travel position (FIG. 2) rests with its inner collar 14 on the shoulder 16 of the larger-diameter part 11 of the control pipe and, in its reverse-travel position (FIG. 3), rests with its rear end 20 in front of a stop shoulder 21 of the guide pipe 15.

When a change is made from forward travel to reverse travel, that is to say when the control sleeve 10 is displaced from its position according to FIG. 2 into its position according to FIG. 3, control air is led from the outside via the control-air duct 18 into the control chamber 17, and with the aid of this control air the control sleeve 10 is displaced reverses counter to the force of the return spring 19 until its rear end 20 strikes the stop shoulder of the guide pipe 15, and opens the control openings 13 in the larger-diameter part of the control pipe. In order to change over from reverse travel (FIG. 3) to forward travel, the control chamber 17 is vented via the control-air duct 18, so that the return spring 19 moves the control sleeve 10 back into the forward-travel position (FIG. 2).

During its movement between its two end positions, the control sleeve 10 is acted on at the end by the operational compressed air only when the control openings 13 in the control pipe 4 are open. However, this is not of decisive importance, since the end face of the control sleeve is very small overall.

What is claimed is:

1. A ram drilling tool comprising:

a percussion piston which is moved pneumatically in a casing, the percussion piston having a jacket, a control pipe fixed to the casing and having at least one control opening, a control sleeve which is axially displaceable on the control pipe, wherein the control sleeve is in constant direct contact with the jacket of the percussion piston, a control chamber, connected to a control-air line, between the control pipe and the control sleeve, and an outer collar, terminating flush with a front end of the control sleeve, at the front end of the control pipe.

2. The ram drilling tool according to claim 1, wherein in a forward drive direction, the control opening is arranged behind the outer collar.

3. The ram drilling tool according to claim 1, wherein the control sleeve 10 is supported axially in the tool casing by means of a prestressed spring.

4. The ram drilling tool according to claim 1, wherein the control chamber is arranged between a rear shoulder of the control pipe and an inner collar of the control sleeve.

5. The ram drilling tool according to claim 1, wherein the axial movement of the control sleeve is limited by a rear stop shoulder.

6. The ram drilling tool according to claim 4, wherein a control-air duct in the region of the rear shoulder of the control pipe opens into the control chamber.

7. The ram drilling tool according to claim 1, wherein the control pipe is provided with a longitudinal groove opening into the control chamber and is surrounded by a guide pipe.

* * * * *